United States Patent [19]

DeYoung

[11] Patent Number: 4,753,605

[45] Date of Patent: Jun. 28, 1988

[54] ELECTRICAL CONNECTOR

[75] Inventor: Roger L. DeYoung, Nolensville, Tenn.

[73] Assignee: The Murray Manufacturing Co., Brentwood, Tenn.

[21] Appl. No.: 27,269

[22] Filed: Mar. 18, 1987

[51] Int. Cl.[4] ..... H01R 13/432

[52] U.S. Cl. ..... 439/347; 439/733

[58] Field of Search ..... 439/347, 350, 699, 733–740

[56] References Cited

U.S. PATENT DOCUMENTS 681,868 9/1901 Bowen ..... 439/699

4,634,204 1/1987 Detter et al. ..... 439/347

*Primary Examiner*—Joseph H. McGlynn

*Attorney, Agent, or Firm*—Cushman, Darby & Cushman

[57] ABSTRACT

A connector for controlling the operation of a vehicle engine is disclosed, the connector including a male connector element having first and second contacts fixedly retained therein and a female connector element having first and second resilient terminals fixedly retained therein. The first and second terminals of the female element are each provided with an arcuate end portion disposed so that the arcuate end portions of the terminals normally contact one another. When the male element is inserted into the female element, the arcuate end portions of the terminals in the female element are separated from one another and make contact with the first and second contacts of the male element. This contact permits the vehicle engine to be controlled by the switch. On the other hand, if the connector elements are uncoupled, the arcuate end portions of the female connector element are in contact with one another so as to complete and close a circuit defined by wires coupled to the terminals of the female element. Completion of this circuit prevents operation of the vehicle's engine. Accordingly, the vehicle operator must properly connect the male and female elements in order to use the vehicle and, as such, controlled operation of vehicle's engine is facilitated.

20 Claims, 3 Drawing Sheets

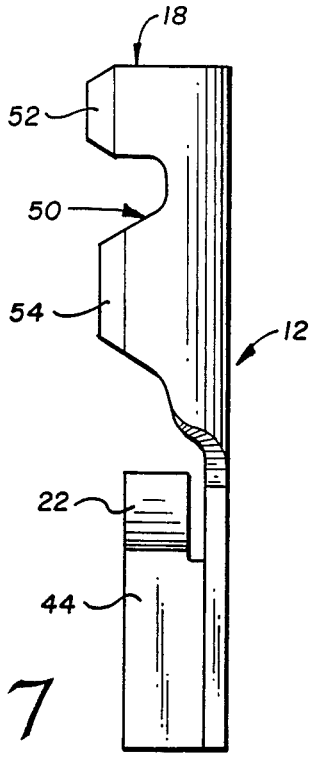
Fig. 7
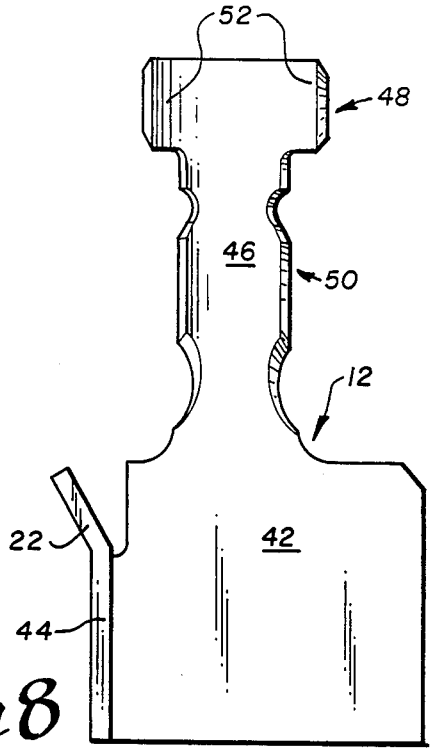
Fig. 8
Fig. 9
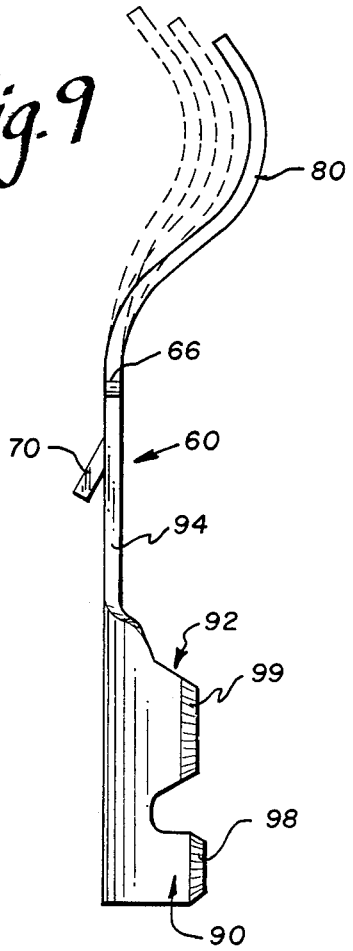
Fig. 10
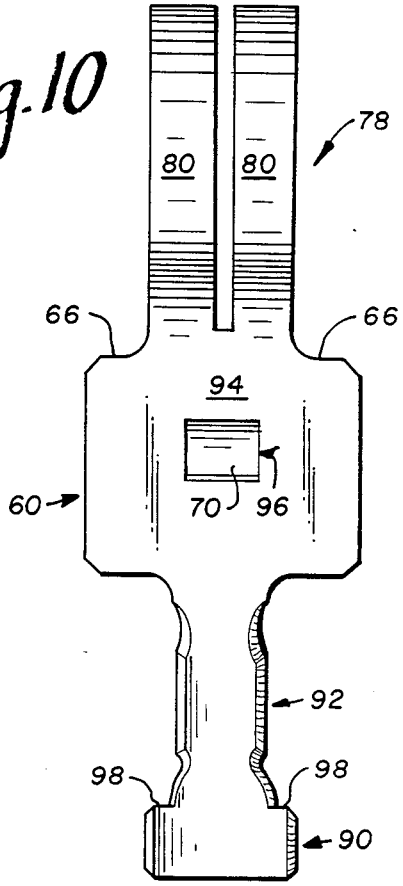

ELECTRICAL CONNECTOR

BACKGROUND OF THE INVENTION

The present invention relates to an electrical connector particularly suitable for use with the engine shutdown circuit of a vehicle, such as riding lawn mower.

More particularly, when the operation of an engine is controlled by a switch, for example provided in the vehicle seat so that operation of the vehicle is only possible when the operator is seated, the switch is typically electrically coupled to the engine ignition system so as to complete a circuit to ground. When the switch is closed, the circuit to ground is closed and operation of the engine is prevented. A standard male-female coupler typically provides the electrical coupling in such a system with first and second terminals of one connector coupled to the switch and first and second terminals of the other connector coupled to the engine ignition system and ground, respectively.

Devices having a first and second terminal-carrying elements that are coupled together to complete an electrical circuit are known generally as disclosed, for example, in U.S. Pat. Nos.: 1,018,334, 1,288,906, 1,422,318, 1,658,832, 1,825,919, 2,368,914, 2,848,706, 3,127,484, 3,267,410, 3,536,869, 4,363,941, and 4,402,564.

A disadvantage with the above-mentioned connector systems is that when the connectors are uncoupled due to jostling of the vehicle, for example, the engine can continue to operate despite switch closure because the circuit to ground remains open until the connectors are again coupled together. When this circuit is open, the engine is not controlled by the switch on the connector and therefore the engine can continue to run, even if such operation is undesirable. Indeed, some operators purposefully separate the connectors so that continuous operation of the vehicle is possible even without the operator being seated in the vehicle seat.

In view of the foregoing, it would be desirable to provide a connector system for electrically connecting a switch for engine shutdown that enables control of engine operation/shutdown when the connectors are coupled and prevents engine operation when the connectors are uncoupled. With such a system, if the connectors become detached, engine shutdown would follow and undesirable, uncontrolled operation of the associated vehicle would be prevented.

SUMMARY OF THE INVENTION

The present invention enables the realization of the aforementioned desirable characteristics. More particularly, a female connector element is provided which has two spring-like terminals which normally press against each other. When a male connector element is inserted into the female element to separate the latter's terminals, two contacts on the male element respectively engage the terminals of the female element. This engagement completes an electrical connection through the connector elements so that switch control of engine operation is possible. However, when the couplers are detached, the engagement of the spring-like terminals of the female connector, which are coupled to the engine ignition system and ground, respectively, closes the circuit to ground. Thus, when the connectors are detached, engine operation is shutdown.

Other objects, features, and characteristics of the present invention, as well as the methods of operation and functions of the related elements of the structure, and the combination of parts and economies of manufacture, will become more apparent upon consideration of the following description and the appended claims, with reference to the accompanying drawings, all of which form a part of this specification, wherein like reference numerals designate corresponding parts in the various figures.

BRIEF DESCRIPTION OF THE DRAWINGS

FIG. 7 is a side elevational view of a male connector element contact in accordance with the present invention;

FIG. 8 is a front elevational view of the male connector element of FIG. 7;

FIG. 9 is a side elevational view of a female connector element in accordance with the present invention; and FIG. 10 is a front elevational view of the female connector element terminal of FIG. 9.

DETAILED DESCRIPTION OF A PREFERRED EMBODIMENT OF THE INVENTION

Figure 1:
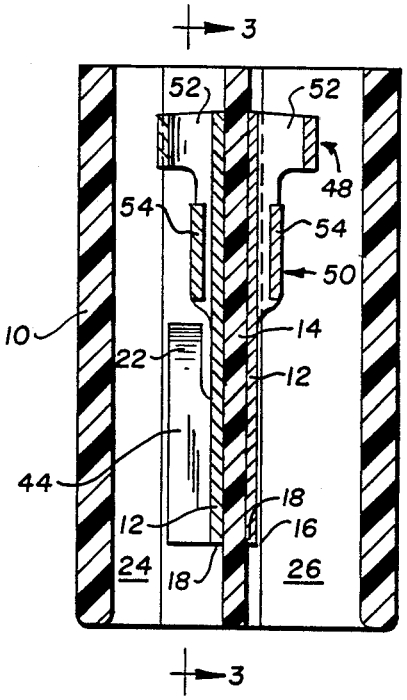
FIG. 1 is a side elevational view, partially in section, of a male connector element in accordance with the present invention.
Figure 3:
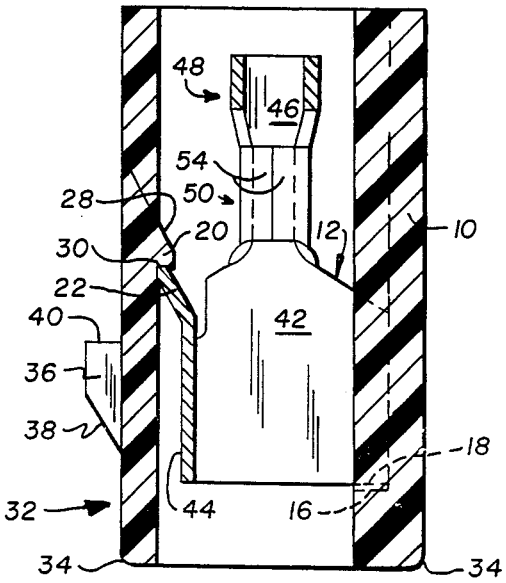
FIG. 3 is a sectional view taken along line 3—3 of FIG. 1.
Figure 5:
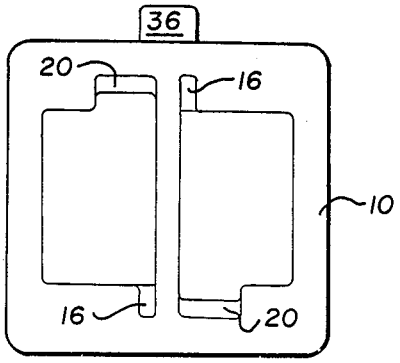
FIG. 5 is a top plan view of the housing of the male connector element of FIG. 1.

Referring to FIGS. 1, 3 and 5, a male connector element formed in accordance with the present invention is shown. The male element comprises a generally rectilinear housing 10 (of square cross-section in the illustrated embodiment) formed of a polymeric material and containing first and second identical contacts 12 which will be described more particularly with reference to FIGS. 7 and 8. Contacts 12 are insulated from one another by being disposed on opposite sides of a wall 14 which divides the interior of the housing. Each contact 12 is retained within the housing between a ledge 16, formed on the house's interior to engage one end 18 of contact 12, and a projection 20 similarly formed within the housing. The latter engages a projecting arm portion 22 provided on contact 12 intermediate its ends.

Projections 20 are formed within the first and second contact receiving compartments 24, 26 defined by wall 14. Each projection includes an inclined surface 28 and a flat portion 30. When a contact 12 is inserted into its respective receiving compartment 24, 26 of housing 10, projecting portion 22 formed on the contact is deflected by inclined surface 28 of projection 20. Upon full insertion, end 18 of contact 12 abuts ledge 16. Since projecting portion 22 at that time has passed projection 20, it will flex outwardly to rest immediately adjacent flat portion 30 of projection 20, as can be seen in FIG. 3. Thus, engagement of projecting portion 22 with flat portion 30 prevents removal of contact 12.

Referring to FIGS. 1 and 3, insertion end 32 of the male connector element housing is provided with arcuate shaped edges 34 to facilitate easy slidable engagement with the female element, as will be more fully described below. In addition, a projection 36 (FIGS. 3 and 5) is provided on at least one face of the exterior surface of the male element's housing. This projection 36 includes an inclined surface 38 and a flat portion 40 (FIG. 3) which are used in releaseably locking the male element within the female element as also will be more fully described below.

Referring now to FIGS. 7 and 8, a contact 12 for the male connector element is shown in greater detail. As can be seen, contact 12 includes a first relatively wide end portion 42 and a locking portion 44 that extends from an edge of portion 42 at an angle of about 90°. Locking portion 44 includes projection 22 adapted to engage projection 20 within the male element's housing, as described above.

Contact 12 further includes a reduced width portion 46 which includes first and second wire coupling portions 48, 50. Portions 48, 50 include at their edges ears 52 and 54, respectively, which are adapted to be crimped so as to grasp and retain wires (not shown), as will be described more fully below.

Figure 2:
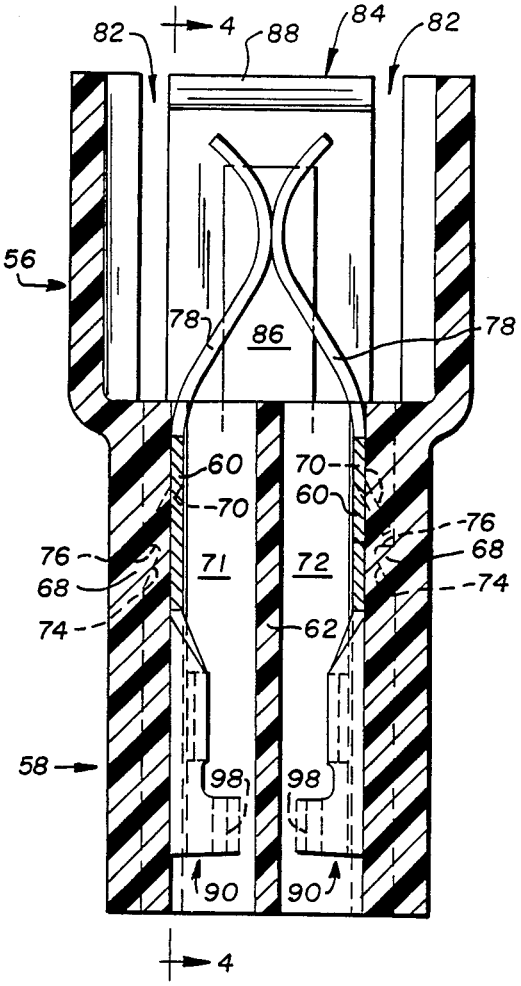
FIG. 2 is a side elevational view, partially in section, of a female connector element in accordance with the present invention.
Figure 4:
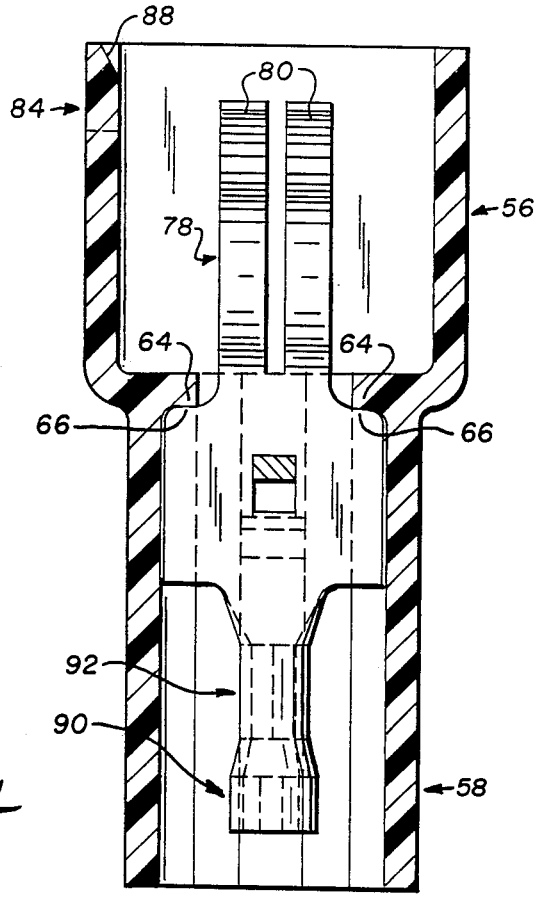
FIG. 4 is a sectional view taken along line 4—4 of FIG. 2.
Figure 6:
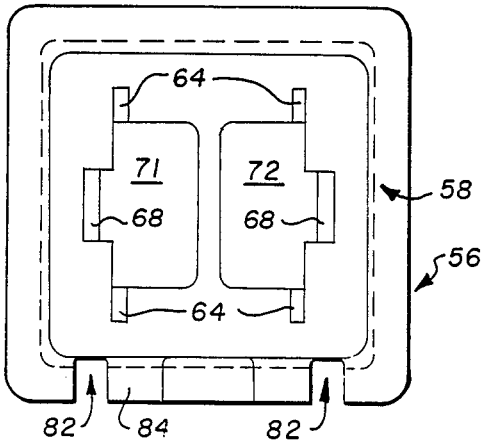
FIG. 6 is a bottom plan view of the housing of the female connector element of FIG. 2.

Referring now to FIGS. 2, 4 and 6, a female connector element is shown. The female element includes a housing provided with an enlarged end portion 56 which is adapted to receive insertion end 32 of the male element. The female element's housing further comprises a second portion 58 of reduced cross-sectional area which includes means for lockably receiving a pair of resilient terminals 60, which will be described more fully with reference to FIGS. 9 and 10. The female element's housing also includes an interior wall 62 which separates and insulates first and second spring terminals 60 from one another within portion 58 of the female element.

The means for lockably receiving the resilient terminals 60 within the female element's housing includes stops 64 formed on the housing's interior adjacent to where portions 56 and 58 meet. These stops engage shoulder portions 66 provided on each of terminals 60. Projections 68 for engaging respective resilient tabs 70 provided on each terminal 60 also are formed within portion 58 of the female element's housing.

Within each of the first and second terminal receiving compartments 71, 72 defined by wall 62, a projection 68 is formed on the interior surface of the housing. Projections 68 each have an inclined surface 74 and a flat portion 76. Resilient tab 70 formed on each terminal 60 is deflected towards the body of the terminal as the terminal is inserted into its respective compartment 71, 72 past first and second projections 68. When terminal 60 is inserted to the point where shoulder portion 66 engages its respective stop 64, tab 70 is disposed above projection 68, permitting portion 70 to spring outwardly so as to engage flat portion 76 of the projection (as is shown in FIG. 2 in broken lines). In this manner, terminal 60 is retained within the female element's housing.

As can also be seen in FIG. 2, the terminals 60 are provided with arcuate end portions 78 curved so that when terminals 60 are disposed within the female element's housing and the female element is not coupled with the male element, portions 78 contact one another within enlarged end portion 56 of the housing. This contact completes the electrical circuit through the wires to which the female connector element is joined.

Referring more particularly to portion 56 of the female element which receives the male element (FIG. 2), it can be seen that first and second cutouts 82 are provided in the female element's housing so as to form a resiliently deflectable sidewall 84 in the housing. Sidewall 84 is provided with a central cutout 86 which is adapted to receive exterior projection 36 (FIG. 3) provided on the male element.

As can be more clearly seen with reference to FIG. 4, sidewall 84 includes an inclined surface 88 which, when male element end 32 is inserted into the female element, is engaged by projection 36 to deflect the sidewall. When end 32 has been fully inserted, projection 36 enters cutout portion 86 allowing resilient sidewall 84 of the female element return to its original position thereby releaseably locking the male element within the female element in a manner which resists forces, such as bumps or jolts, that tend to separate the connect of elements. It is apparent, however, that the elements may be quickly and easily separated by flexing the sidewall 84 outwardly and withdrawing the male element, at which point arcuate portions 78 of the female element contact one another within enlarged end portion 56 of the housing. This completes the circuit through the wires to which the female connector element is joined and shuts down the engine to which the female connector is coupled.

Referring now to FIGS. 9 and 10, terminal 60 will be described in greater detail. First and second wire receiving and retaining means 90, 92 are provided at the end of the terminal, opposite arcuate portion 78. Each of these retaining protions 90, 92 includes ears 98, 99, respectively, which are adapted to be crimped so as to grasp and retain wires (not shown). Portion 78 itself is formed from first and second spaced strips 80 projecting from a relatively wide central body portion 94 of terminal 60, adjacent shoulders 66. Finally, tab 70 of terminal 60 is formed by means of a cutout 96 in the center of main body portion 94.

It is apparent from the foregoing description that the male and female connector elements are assembled as follows:

The first and second contacts 12 of the male element are operatively coupled to respective wires (not shown) by crimping exposed ends of the wire within the ears 52, 54 of a respective contact. The contacts are then inserted, large end first, into respective compartments 24, 26 of the male element where they are locked, as previously described. Similarly, terminals 60 of the female element are operatively coupled to respective wires (not shown) by crimping ears 98, 99 of each terminal 60 about an exposed end of the wire. Terminals 60 are then inserted, arcuate ends 78 first, into compartments 71, 72 of the female element where they are retained, as has also been described. Arcuate ends 78 of terminals 60 so disposed in the female element are normally in contact with one another completing the circuit through the wires to which female connector element is joined.

When an electrical connection to the switch is desired, insertion end 32 of the male connector element is caused to be inserted into portion 56 of the female connector element. Wall 14 of the male element moves between the arcuate portions 78 of terminals 60 of the female element causing portions 78 to be separated and electrically insulated from one another. Furthermore, complete insertion of the male element into the female element causes first and second arcuate portions 78 of the female element to engage first and second contacts 12 of the male element. Such engagement completes the electrical connection of the wires secured to the male and female connector elements. This connection is reliably maintained as a result of the locking relationship between projection 36 and sidewall element 84, described above. However, the locking relationship is releaseable thereby permitting the male and female elements to be separated to disrupt the electrical connection to the switch and to close the circuit through the wires of the female connector.

While the invention has been described in connection with what is presently considered to be the most practical and preferred embodiment, it is to be understood that the invention is not to be limited to the disclosed embodiment, but instead is intended to cover various modifications and equivalent arrangements included within the spirit and scope of the appended claims.

What is claimed is:

1. An electrical connector comprising:

a male connector element including first and second contacts, said contacts being fixedly retained within a housing for said male element and being electrically insulated from one another by a wall within said housing;

a female connector element including first and second resilient terminals fixedly retained therein, said terminals each including arcuate end portions disposed relative to one another so that the arcuate portions normally are in contact so as to complete an electrical circuit between wires coupled to said first and second terminals, respectively, said terminals being retained in said female element by engagement of shoulders defined on each of said terminals with respective stops provided on the interior of said female element and by interlocking engagement of a projecting portion of each terminal with a respective projection formed on the interior of the female element; and means for releasably joining said male element to said female element whereby when the male element is inserted into the female element, the wall of the male element engages and causes the arcuate end portions of the terminals of the female element to separate and operatively engage the first and second contacts of the male connector, respectively, to thereby provide an electrical connection between said male element and said female element.

2. A connector according to claim 1, further comprising means for releaseably locking together the male and female elements, said locking means including a projection formed on the outer surface of said male element's housing which cooperates with a resilient sidewall of said female element, the sidewall having a cutout portion sized to receive said locking projection whereby, when the male element's housing inserted into the female element, the locking projection deflects said sidewall and whereby further insertion of said housing aligns said locking projection with the cutout so that the locking projection is received within the cutout to lock the connectors together.

3. A connector according to claim 1, wherein each said contact includes first and second wire gripping and retaining means adapted to be crimped about a wire.

4. A connector according to claim 1, wherein each said terminal includes first and second wire gripping and retaining means adapted to be crimped about a wire.

5. A connector according to claim 4, wherein said female element includes: an enlarged end portion adapted to receive said male element's housing and in which are disposed the arcuate end portions of said terminals; and an end portion of reduced cross-section in which said wire gripping and retaining means of said terminals are disposed.

6. A connector according to claim 5, wherein said reduced cross-section end portion further includes a wall for electrically insulating the terminals from one another.

7. A connector according to claim 6, wherein each said contact includes first and second wire gripping and retaining means adapted to be crimped about a wire.

8. An electrical connector comprising:

a male connector element including first and second contacts, said contacts being fixedly retained within a housing for said male element and being electrically insulated from one another by a wall within said housing, said contacts being retained in said male element by the abutment of an end of each contact with a respective stop shoulder defined on the interior of said male element's housing and by interlocking engagement of a resilient tab on each contact and a respective projection formed on the interior of said housing;

a female connector element including first and second resilient terminals fixedly retained therein, said terminals each including arcuate end portions disposed relative to one another so that the arcuate portions normally are in contact so as to complete an electrical circuit between wires coupled to said first and second terminals, respectively; and means for releasably joining said male element to said female element whereby when the male element is inserted into the female element, the wall of the male element engages and causes the arcuate end portions of the terminals of the female element to separate and operatively engage the first and second contacts of the male connector, respectively, to thereby provide an electrical connection between said male element and said female element.

9. A connector according to claim 8, further comprising means for releasably locking together the male and female elements, said locking means including a projection formed on the outer surface of said male element's housing which cooperates with a resilient sidewall of said female element, the sidewall having a cutout portion sized to receive said locking projection whereby, when the male element's housing is inserted into the female element, the locking projection deflects said sidewall and whereby further insertion of said housing aligns said locking projection with the cutout so that the locking projection is received within the cutout to lock the connectors together.

10. A connector according to claim 8, wherein each said contact includes first and second wire gripping and retaining means adapted to be crimped about a wire.

11. A connector according to claim 8, wherein each said terminal includes first and second wire gripping and retaining means adapted to be crimped about a wire.

12. A connector according to claim 11, wherein said female element includes an enlarged end portion adapted to receive said male element's housing and in which the arcuate end portions of said terminals are disposed, and an end portion of reduced cross section in which said wire gripping and retaining means of said terminals are disposed.

13. A connector according to claim 12, wherein said reduced cross section end portion further includes a wall for electrically insulating the terminals from one another.

14. A connector according to claim 13, wherein each said contact includes first and second wire gripping and retaining means adapted to be crimped about a wire.

15. An electrical conductor comprising:

a male connector element including first and second contacts, said contacts being fixedly retained within a housing for said male element and being electrically insulated from one another by a wall within said housing;

a female connector element including first and second resilient terminals fixedly retained therein, said terminals each including arcuate end portions disposed relative to one another so that the arcuate portions normally are in contact so as to complete an electrical circuit between wires coupled to said first and second terminals, respectively;

means for releasably joining said male element to said female element whereby when the male element is inserted into the female element, the wall of the male element engages and causes the arcuate end portions of the terminals of the female element to separate and operatively engage the first and second contacts of the male connector, respectively, to thereby provide an electrical connection between said male element and said female element; and means for releasably locking the male and female elements together, said locking means including at least first and second axial slots defined in a side wall of said female element so as to define a deflectable tab portion, said tab portion having a cutout portion defined therethrough, and a projection formed on the exterior surface of said male element, said cutout portion being sized so as to receive said locking projection whereby when the male element is inserted into the female element, the locking projection engages and deflects said tab portion and whereby further insertion of said male element aligns said locking projection with the cutout portion such that the locking projection is received within the cutout to lock the connector elements together.

16. A connector according to claim 15, wherein said terminals are retained in said female element by engagement of shoulders defined on each of said terminals with respective stops provided on the interior of said female element and by interlocking engagement of a projecting portion of each terminal with a respective projection formed on the interior of the female element.

17. A connector according to claim 15, wherein said contacts are retained in said male element by the abutment of an end of each contact with a respective stop shoulder defined on the interior of said male element's housing and by interlocking engagement of a resilient tab on each contact and a respective projection formed on the interior of said housing.

18. A connector according to claim 15, wherein said reduced cross section end portion further includes a wall for electrically insulating the terminals from one another.

19. A connector according to claim 15, wherein each said terminal includes first and second wire gripping and retaining means adapted to be crimped about a wire.

20. A connector according to claim 19, wherein said female element includes an enlarged end portion adapted to receive said male element's housing and in which the arcuate end portions of said terminals are disposed, and an end portion of reduced cross section in which said wire gripping and retaining means of said terminals are disposed.

* * * * *